US011828149B1

(12) United States Patent
Tian et al.

(10) Patent No.: US 11,828,149 B1
(45) Date of Patent: Nov. 28, 2023

(54) FRACKING TOOL WITH ELECTROMAGNETIC INTELLIGENT CONTROL SLIDING SLEEVE

(71) Applicants: Southwest Petroleum University, Chengdu (CN); Nantong Xieming Technology Co., Ltd., Nantong (CN); Sichuan Xieming Technology Co., Ltd., Chengdu (CN)

(72) Inventors: Jialin Tian, Chengdu (CN); Yu Wei, Chengdu (CN); Lanhui Mao, Chengdu (CN); Yanniu Ren, Chengdu (CN); Chunyu Xing, Chengdu (CN); Junyang Song, Chengdu (CN); Lei Cha, Chengdu (CN); Lin Yang, Chengdu (CN)

(73) Assignees: Southwest Petroleum University, Chengdu (CN); Nantong Xieming Technology Co., Ltd., Nantong (CN); Sichuan Xieming Technology Co., Ltd., Chengdu (CN)

( * ) Notice: Subject to any disclaimer, the term of this patent is extended or adjusted under 35 U.S.C. 154(b) by 0 days.

(21) Appl. No.: 18/155,058

(22) Filed: Jan. 16, 2023

(30) Foreign Application Priority Data

Dec. 14, 2022 (CN) ..... 202211599507.4

(51) Int. Cl.
*E21B 34/14* (2006.01)
*E21B 43/26* (2006.01)

(52) U.S. Cl.
CPC ..... *E21B 43/26* (2013.01); *E21B 34/142* (2020.05)

(58) Field of Classification Search
CPC ..... E21B 34/14; E21B 34/142
See application file for complete search history.

(56) References Cited

U.S. PATENT DOCUMENTS 9,683,419 B2 * 6/2017 Coon ..... E21B 47/09
10,125,573 B2 * 11/2018 Flores Perez ..... E21B 34/14

FOREIGN PATENT DOCUMENTS

EP 2728108 A1 * 5/2014 ..... E21B 33/127
WO WO-2022236083 A1 * 11/2022

* cited by examiner

*Primary Examiner* — Matthew R Buck
(74) *Attorney, Agent, or Firm* — Andrew D. Fortney; Central California IP Group, P.C.

(57) ABSTRACT

An oil and gas fracturing tool is disclosed, mainly involving a fracking tool with an electromagnetic intelligent control sliding sleeve including an outer sleeve section, a dart body section and a control section. The outer sleeve section is at the target location to be fractured. The effect of fracturing is mainly achieved by the dart body, which has an activated state and an inactive state. The initial state is inactive, and the front locking tip can be deformed under pressure during displacement. The diameter can change to pass through any sliding sleeve. When the dart body is counted and is about to reach the fracturing position, the front locking tip is blocked from deformation and cannot be reduced in diameter, thus pressurizing to control the fracturing effect. The control part includes a sensor module, a drive module, a main control module and a power supply module.

13 Claims, 6 Drawing Sheets

FRACKING TOOL WITH ELECTROMAGNETIC INTELLIGENT CONTROL SLIDING SLEEVE

TECHNICAL FIELD

The invention relates to a fracturing tool for the exploitation of oil and natural gas and other geological resources, in particular to a fracking tool with an electromagnetic intelligent control sliding sleeve, belonging to the technical field of staged fracturing of oil and gas wells.

BACKGROUND OF THE INVENTION

Currently, there are a large number of unconventional resources, and due to the difficulty of exploitation, it is necessary to form as many artificial fractures in the formation as possible through the staged fracturing technology, so as to develop economically and effectively. Segmented fracturing technology has become an effective technical means to increase production in low-permeability tight oil and gas reservoirs, and effectively increases oilfield production in the actual exploitation process of oilfields, which is a widely used means of increasing production in oilfields. In recent years, the staged fracturing technology of oil and gas wells has made great progress, realizing the unlimited stage staged fracturing and efficient and fast construction of unconventional reservoirs in the field production. The application of staged fracturing technology provides technical support for improving the seepage condition of oil and gas well and increasing the production of single well.

Fracturing sleeve is the key technology of staged fracturing tools in oil and gas wells, which greatly affects the efficiency of oil and gas production. At present, the commonly used sliding sleeves are mainly pitching type, and the number of fracturing stages depends entirely on the number of sliding sleeves that can be installed, and the pitching size specifications must be held in the order of small to large, so the number of sliding sleeves put into the well is limited, which affects the rate and yield of fracturing. Although the mechanical and hydraulic types can achieve infinite stages of fracturing, the mechanical type requires the help of specific tools to achieve switching, and the construction period is cumbersome and long; Although the hydraulic type can achieve unlimited fracturing and the construction period is short, it is difficult to control the hydraulic pressure and the fracturing accuracy is not high. Due to many limitations, a fracturing tool that can accurately position, achieve precise fracturing, and have no limit on the number of fracking stages is required.

SUMMARY OF THE INVENTION

In view of the above technical defects, the invention provides a fracking tool with an electromagnetic intelligent control sliding sleeve. While reaching the infinite stages, it can also switch the working state of the dart body through the acquisition of signals, and accurately locate the external casing part to achieve accurate identification and precise fracturing.

The technical solution of the present invention concerns a fracking tool with an electromagnetic intelligent control sliding sleeve, comprising an outer sleeve section, a dart body section and a control section; wherein the outer sleeve section comprises a front casing pipe, a nozzle plug, a piston barrel and a back casing pipe; the dart body section comprises a plugging ball, snap claws, a snap screw, a ball seat snap ring, a magnet cover and a magnet, an upper latch, a rear inner tube, a rubber sleeve, a snap locking cylinder, a lower latch, a strain sensor cover and a strain sensor, a conduit, a magnetic sensor cover and a magnetic sensor, a sliding snap ring, a front inner tube, a magnetic induction coil, an electric latch and a snap ring screw; the control part circuit comprises four modules: namely a main control module, a drive module, a power supply module and a sensor module, and all four modules are integrated on a printed circuit board (PCB). The sensor module includes two parts: a strain sensing module and a magnetic sensing module. The power supply module includes three parts: a power supply circuit, a power control circuit and an energy storage circuit. The drive module comprises a coil action circuit and an electric plug activation circuit.

The front casing pipe and the back casing pipe in the outer sleeve section are connected by threaded fittings, and go down the well together with the sleeve and are fixed in the sleeve.

The snap claws may comprise 8 claws evenly distributed along the circumference, and the upper part of the claw head extends slightly inward to form a boss so that the ball does not fall out of the sliding sleeve, and can move axially. The bottom of the snap claws includes 4 threaded holes corresponding to the ball seat snap ring, and the bottom of the snap claws and the ball seat snap ring are connected by snap screws.

The ball seat snap ring is configured with a cylindrical hole for installing an electric latch, one end of the cylindrical hole is connected with the snap claws, another end of the cylindrical hole is connected to the front inner tube, the lower end face is evenly configured with 4 counterbores, and the bottom of the ball seat snap ring is configured with an inner groove for installing the magnet(s). The sliding snap ring is magnetic, which can produce adsorption and repulsion effects with the magnetic induction coil. The electric latch comprises a latch shaft, a latch spring, a latch baffle, a snap ring, a latch coil, a latch sleeve and an electric latch shell.

The tip of the front inner tube is configured with four threaded holes, sealing grooves, sealing cavities, an external threaded fitting and a bowl groove. The rear inner tube, the upper latch and the lower latch form a sealing cavity for mounting the control section. The rubber sleeve corresponds to the shape of the bowl groove on the rear inner tube, and the open part of the leather bowl has a rectangular groove of a certain width.

The upper end of the upper latch comprises 12 grapnels, distributed evenly and circumferentially, and the lower end of the upper latch is provided with an internal threaded fitting connected with the lower latch. The upper latch includes 3 threaded holes (e.g., in a middle thereof) to install strain sensors. The tip of the upper latch deforms under pressure and is equipped with a magnet block or sensor to detect the deformation of the upper latch. The upper end of the lower latch is configured with an external threaded fitting connected with the upper latch, and the lower end of the lower latch is configured with a boss and a snap locking cylinder to match. The snap locking cylinder is configured with an internal threaded fitting inside, which is connected with the external threaded fitting on the rear inner tube.

A circuit in the control part comprises the main control module, the driving module, the sensing module and the power supply module. The main control module comprises a main control chip, an input port and an output port. The input port contains two signal input ports and a power port. The drive module comprises a coil action circuit and an electric plug activation circuit. The coil action circuit comprises two brush-type DC motor drivers (e.g., DRV8870DDAR motor drivers available from Texas Instruments). The plug activation circuit comprises a Schottky diode and an N-channel MOS diode. The sensor module comprises a strain sensing device and a magnetic sensing device. The strain sensing device includes a first instrumentation amplifier (e.g., an INA333AIDGKT instrumentation amplifier available from Texas Instruments) and a resistor (e.g., an ERA-3AEB121V metal film resistor available from Panasonic Electronic Components). The magnetic sensing device comprises a second instrumentation amplifier (e.g., another INA333AIDGKT instrumentation amplifier). The power supply module comprises a power supply circuit (a), a control circuit (b) and an energy storage circuit (c). The power supply circuit comprises an N-channel MOS diode (e.g., a DMG3404L-7 diode available from Diodes Incorporated) and two P-channel MOSFETs or MOS diodes (e.g., ASDM30P09ZB-R P-channel MOSFETs available from Ascend Semiconductor Co., Ltd., Shenzhen, China). The control circuit comprises two voltage references (e.g., REF3025AIDBZR 2.5 V voltage references available from Texas Instruments) and two capacitors. The energy storage circuit contains a Schottky diode (e.g., a CRS08(TE85L, Q, M) Schottky diode available from Toshiba Semiconductor and Storage) and 4 parallel capacitors as backup circuits.

The signal detection unit includes three strain sensors and signal transmission cables. The strain sensors are placed or installed in the threaded holes in the upper latch, and after installation, the strain sensor and signal transmission cable may be sealed and protected by welding.

The beneficial effects of the present invention include: (1) a deformable lock is designed so that the dart body portion can change diameter under pressure when not activated, thereby passing through any number of piston stages, and when activated, deformation of the locking tip is prevented and the locking tip cannot pass through the piston, so sufficient pressure is reached to achieve fracturing; (2) the control part accurately locates the position of the specified slide sleeve by collecting and identifying the signals of the strain sensor to achieve accurate fracturing operations; and (3) the sensor transmits the collected deformation signal to the control section, and the control section controls the magnetic induction coil to activate the dart body section, so as to realize the blockage of the flow channel and meet the requirements of limitless fracturing.

Names of parts marked in the attached drawings: 1—plugging ball, 2—front casing pipe, 3—snap claws, 4—snap screw, 5—ball seat snap ring, 6—nozzle plug, 7—magnet cover and magnet, 8—upper latch, 9—piston barrel, 10—rear inner tube, 11—back casing pipe, 12—rubber sleeve, 13—snap locking cylinder, 14—lower latch, 15—strain sensor cover and strain sensor, 16—conduit, 17—magnetic sensor cover and magnetic sensor, 18—sliding snap ring, 19—front inner tube, 20—magnetic induction coil, 21—electric latch, 22—snap ring screw.

DETAILED DESCRIPTION OF THE INVENTION

Figure 1:
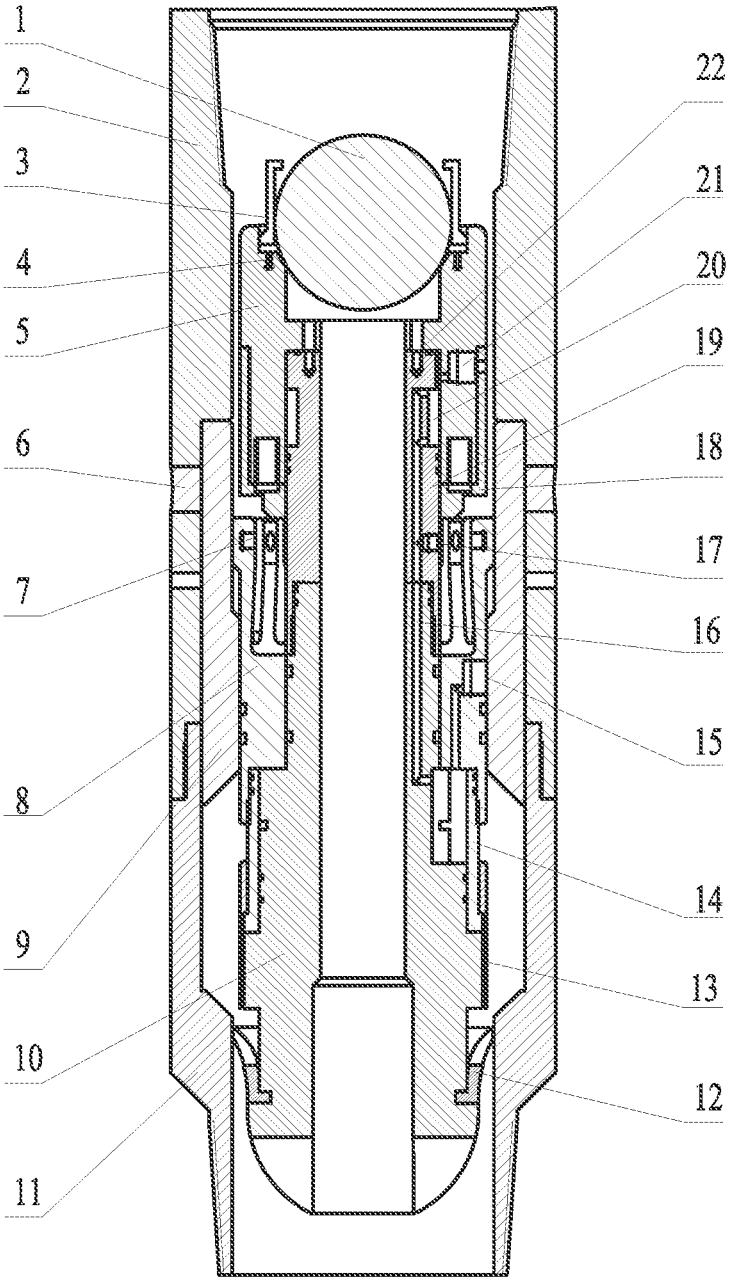
FIG. 1 is the structure diagram of the electromagnetic limitless intelligent sliding sleeve of the invention.

In the present invention, for the convenience of description, the relative positions and/or relations between different components are described according to the view in FIG. 1 of the application. For example, the position(s) and/or relation (s) of the upper and lower parts are determined according to the directions shown in FIG. 1.

According to FIG. 1, a fracking tool with an electromagnetic intelligent control sliding sleeve comprises an outer sleeve section, a dart body section and a control section. The outer sleeve section includes a front casing pipe 2, a nozzle plug 6, a piston barrel 9 and a rear inner tube 11; the dart body section includes a plugging ball 1, snap claws 3, a snap screw 4, a ball seat snap ring 5, a magnet cover and magnet 7, an upper latch 8, a rear inner tube 10, a rubber sleeve 12, a snap locking cylinder 13, a lower latch 14, a strain sensor cover and strain sensor 15, a conduit 16, a magnetic sensor cover and magnetic sensor 17, a sliding snap ring 18, a front inner tube 19, a magnetic induction coil 20, an electric latch 21 and a snap ring screw 22; The control section includes a driving module, a sensing module, a main control module and a power supply module.

The outer sleeve section was run into the well with the sliding sleeve. The outer sleeve is placed at a specified distance in the sleeve, and the fracturing depth can be obtained by recording the number of outer sleeves that the dart body passes through.

The fracking tool with electromagnetic intelligent control sliding sleeves has two states: an inactive state and an active state. FIG. 1 shows the inactive state: when the fracking tool with electromagnetic intelligent control sliding sleeves is not activated, the piston barrel 9 is fixed with the front casing pipe 2 through the pin. At this time, the sliding snap ring 18 in the dart body section is in the initial position and keeps relatively static. When the dart body passes through the piston barrel 9, the outer end of the upper latch 8 contacts with the piston barrel 9. Under pressure, the tip of the upper latch 8 deforms and bends inward to pass through the piston barrel 9. When the sliding sleeve changes from the inactive state to the active state, the current of the magnetic induction coil 20 reverses, repels the sliding snap ring 18 and makes it move to the right, preventing the deformation of the lock. Under the pressure, the pin between the piston barrel 9 and the front casing pipe 2 is cut, and the dart part drives the piston barrel 9 to move downward to contact the nozzle plug 6 with fracturing fluid. When the pressure increases to a certain extent, the nozzle plug 6 is squeezed open and begins to put pressure on the formation.

Figure 2:
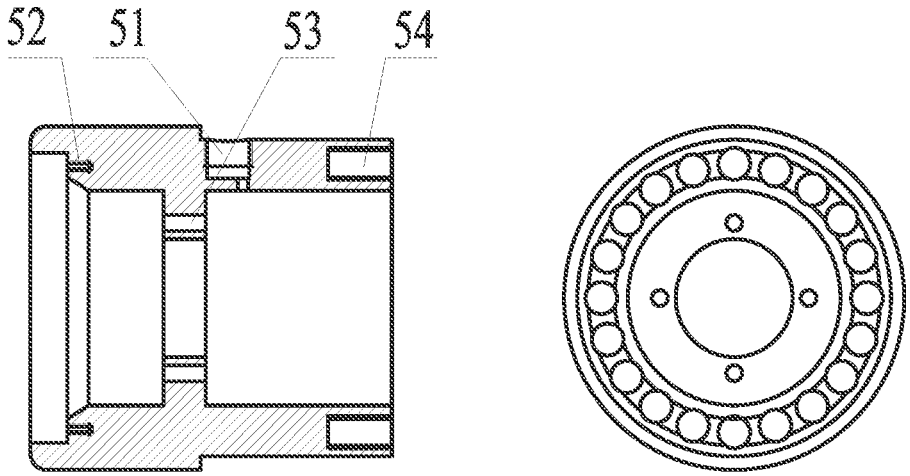
FIG. 2 is the structure diagram of the ball seat snap ring.

Referring to FIG. 2, the ball seat snap ring 5 is provided with a threaded hole 51 for installing the electric latch 21, and the latch shaft of the electric latch extends a threaded hole into the hole of the ball seat snap ring 18. The upper part of the ball seat snap ring 5 is provided with 4 threaded holes 52, which are used to install the snap screws 4, so as to realize the relative static between the snap claw 3 and the ball seat snap ring 5. There are four evenly distributed thread holes 53 in the middle part of the ball seat snap ring 5, which are used to install the clasp ring screws 22 to realize the fixation between the ball seat clasp ring 5 and the front inner tube 19. As shown in the right view, the bottom of the holder clapper 5 has a ring of grooves and 24 cylindrical holes 54 for holding the magnet. There are two choices of magnets, a ring magnet or a single cylindrical magnet.

Figure 3:
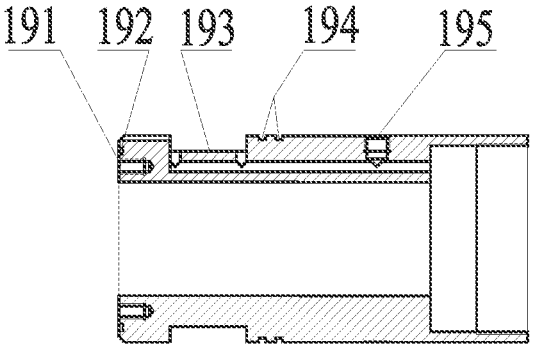
FIG. 3 is the structure diagram of the upper latch.

Referring to FIG. 3, the upper latch 8 and the lower latch 14 are connected by threaded fittings, and there are three thread holes 82 in the middle part for installing the sensors, and the sealing ring 83 is provided to ensure the sealing between the upper latch 8 and the piston barrel 9, so as to prevent the external fracturing fluid from causing damages to the internal circuit. The upper part of the upper latch 8 may have a claw shape, with 12 claw heads, and each claw head is configured with a round hole 81. It is configured to install the magnet. When the buckle is displaced, it can be sensed by the magnetic sensor.

Figure 4:
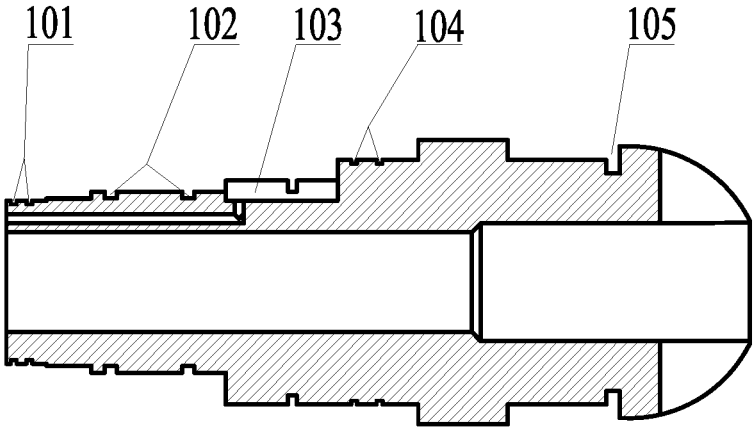
FIG. 4 is the structure diagram of the front inner tube.

Referring to FIG. 4, the upper end of the front inner tube 19 is configured with a threaded hole 191 for installing the snap ring screw 22 to realize the positioning between the ball seat snap ring 5 and the front inner tube 19. The sealing ring 192 and the sealing ring group 194 are configured to install the O-type sealing ring to prevent fracturing fluid from breaking into the electrical latch and the magnetic induction coil to damage the circuit. A groove 193 is configured to hold the magnetic induction coil 20, and the inner side of the groove 193 includes two holes communicating with the wire tube to facilitate the wiring of the coil.

Figure 5:
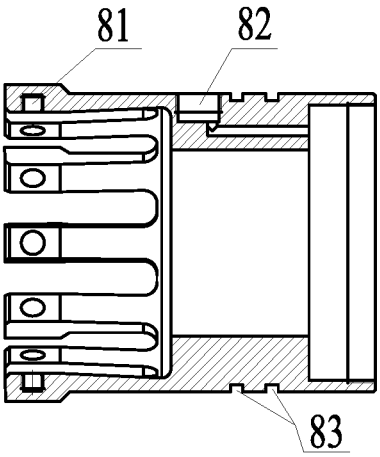
FIG. 5 is the structure diagram of the rear inner tube.

Referring to FIG. 5, the rear inner tube 10 includes with a clamping slot 105 for axial positioning of the rubber sleeve, a sealing cavity 103 for holding the control module, and a plurality of sealing rings. The sealing rings 101 seal a space between the front inner tube 19 and the rear inner tube 10 to prevent fracturing fluid from entering the conduit 16 and damaging the circuit. The sealing ring 102 is configured to seal a space between the upper latch 8 and the rear inner tube 10. Ring 104 is configured to seal between the lower latch 14 and the rear inner tube 10 to prevent fracturing fluid from entering the sealed cavity and damaging the circuit.

Figure 6:
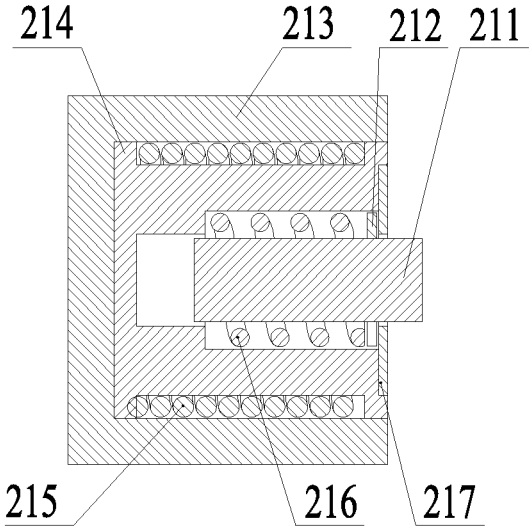
FIG. 6 is a structure diagram of the electric latch.

Referring to FIG. 6, the electrical latch 21 comprises a latch shaft 211, a clasp ring 212, an electrical latch housing 213, a latch sleeve 214, a latch coil 215, a latch spring 216 and a latch baffle 217.

Figure 7:
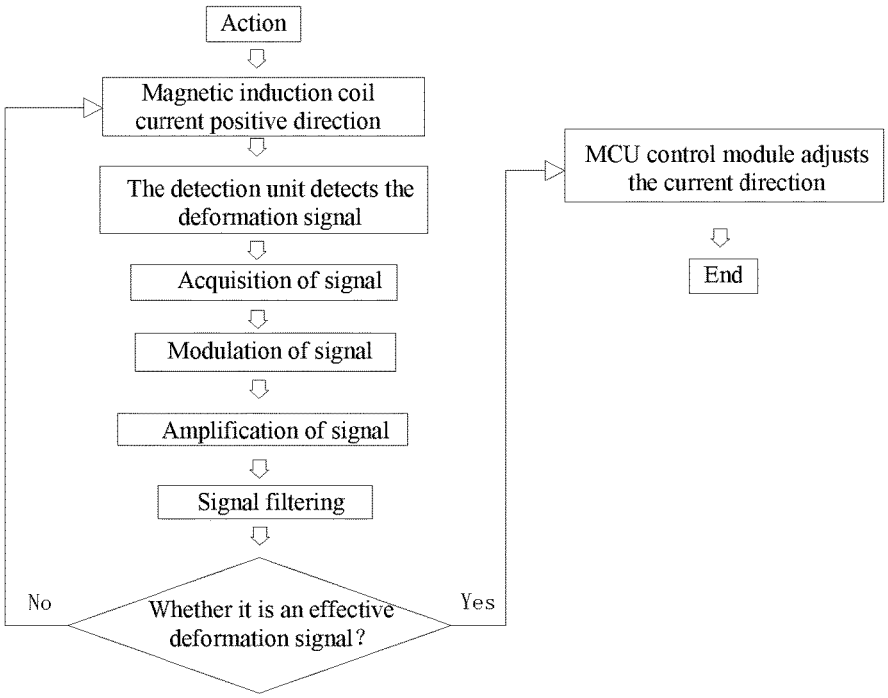
FIG. 7 is the working flow chart of the control section.

The control section includes a signal monitoring and detection unit, a signal acquisition circuit, a modulating signal module, an operation amplifier circuit, a filtering circuit, a main control unit (MCU) core master control module and a power supply module. The control process is shown in FIG. 7. The specific implementation method is as follows: after the dart body part passes through the fracturing piston barrel 9 of an outer sleeve section, the upper latch 8 deforms once. During the deformation, the magnet block at the tip of the upper latch 8 is close to the front inner tube 19. The magnetic sensor detects the change of the magnetic field, and the strain sensor collects the deformation signal and transmits the signal to the signal acquisition circuit. The filter circuit modulates, amplifies and filters the signal, and the main control chip or unit recognizes the processed signal. If it is identified as a valid deformation signal, a count will be made or carried out, and so on. When the count number reaches a predetermined or set value (e.g., a number corresponding to [1] the slip sleeve prior to a target sliding sleeve, or [2] the target sliding sleeve), it will be transformed into an effective deformation signal. The main control module controls the current input to the magnetic induction coil 20 to reverse, and pushes the sliding snap ring 18 to the right to prevent the contraction of the upper latch 8, thus driving the piston barrel 9 to hold pressure. Since the sliding clasp 18 only needs to move a very small distance to realize the limit of the upper latch 8, it only takes a short time for the dart body section to move from the inactive state to the active state, which is less than the time for the dart body section to move from one sliding sleeve to another sliding sleeve, thus ensuring the accuracy of fracturing stages.

Figure 8:
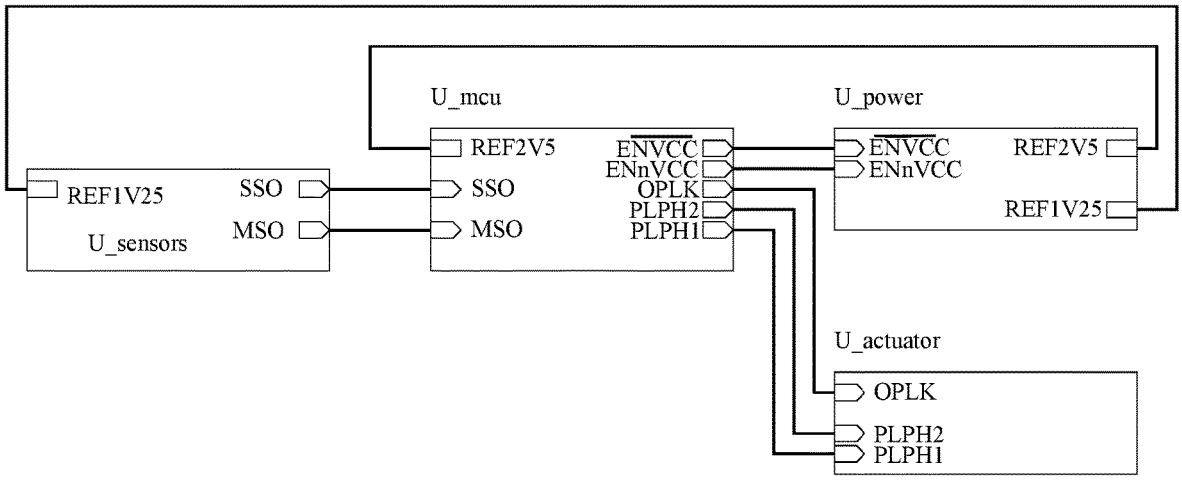
FIG. 8 is the control schematic diagram of the sliding sleeve.

Referring to FIG. 8, the circuit of the control section comprises four modules: the main control module, the drive module, the sensor module and the power supply module. The main control module comprises a main control chip, an input port and an output port. The input port comprises two signal input ports and a power port. A first input port (e.g., SSO) receives the strain signal after processing, and a second input port (e.g., MSO) receives the magnetic sensor signal after processing. The output ports (e.g., PLPH1 and PLPH2) control the forward and reverse current in the electromagnetic coil and generate the magnetic field in the opposite direction, thus controlling the left and right movement of the moving ring. Another output port (e.g., OPLK) controls the current of the coil in the electrical latch to realize the control of the electrical latch. The driver module comprises three input ports, respectively corresponding to the output ports (e.g., PLPH1, PLPH2 and OPLK) in the main control module, which are used to receive control signals from the main control module. The sensor module comprises a strain sensor, an electromagnetic sensor and two output ports, which correspond to the input ports (e.g., SSO and MSO) in the main control module and are used for sensor signal transmission after processing. The power supply module comprises four output ports to provide reference voltage for other modules.

Figure 9:
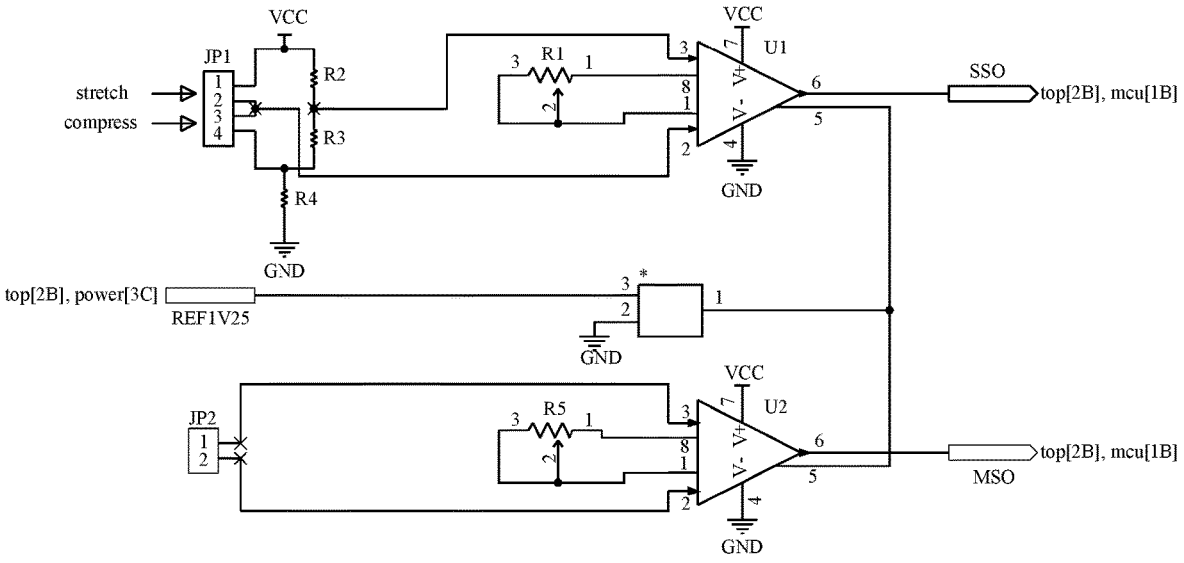
FIG. 9 is the circuit diagram of the power supply module.

Referring to FIG. 9, the sensor module comprises two sensors: a strain sensor and a magnetic sensor. The strain sensor contains an instrumentation amplifier (e.g., the INA333AIDGKT instrumentation amplifier) and a resistor (e.g., the ERA-3AEB121V metal layer resistor), and outputs an SSO signal (e.g., to the SSO port). The INA333AIDGKT instrumentation amplifier device has a general-purpose triple op amp design with a small size and a low power consumption. It has an ultra-low offset voltage, an excellent offset voltage drift, and a high common-mode rejection ratio. The device operates from supplies as low as 1.8 V (±0.9 V) and consumes only 50 μA of quiescent current. The ERA-3AEB121V metal layer resistor has a small resistance tolerance, a high resistance temperature coefficient and a low current noise, and has a stable performance and a high reliability in high temperature and high humidity conditions. When it is stretched or compressed, the strain sensor outputs a different signal. The magnetic sensor has only one instrumentation amplifier (e.g., an INA333AIDGKT instrumentation amplifier), which amplifies the signal from the magnetic sensor to the next stage (e.g., as the MSO signal to the MSO port) when it senses the displacement of the magnet block.

Figure 10:
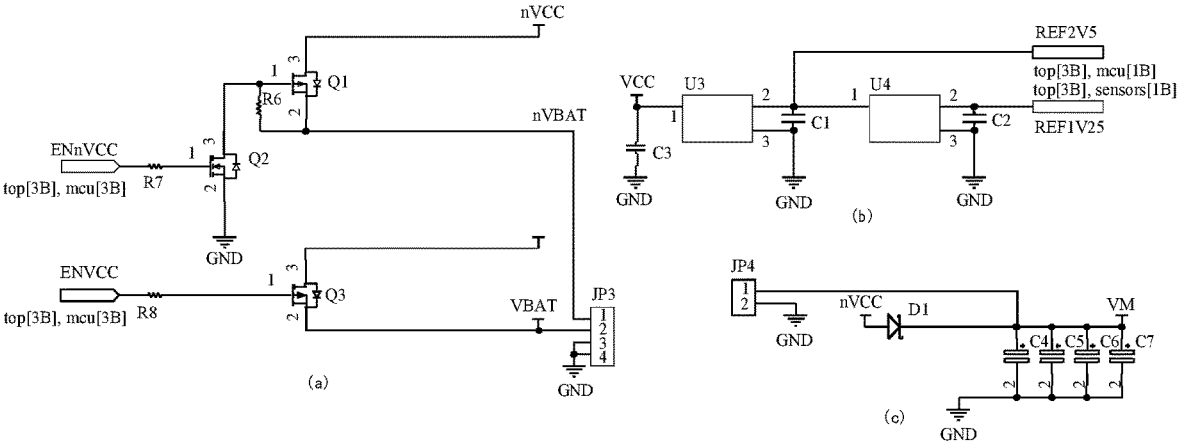
FIG. 10 is the circuit diagram of the drive module.

Referring to FIG. 10, the power supply module comprises a power supply circuit (a), a control circuit (b) and an energy storage circuit (c). The power supply circuit comprises an N-channel MOS diode (e.g., a DMG3404L-7 diode) and two P-channel MOS MOSFETs or diodes (e.g., ASDM30P09ZB-R P-channel MOSFETs). DMG3404L-7 diodes have a low on-resistance, a low input capacitance and a fast switching speed, which can minimize the on-resistance while maintaining an excellent switching performance. ASDM30P09ZB-R P-channel MOSFETs have a high power and an excellent current handling capability. The controller circuit comprises two voltage references (e.g., REF3025AIDBZR 2.5 V voltage references) and two capacitors to provide a stable voltage for the circuit. The REF3025AIDBZR voltage reference is a precision, low-power, low-voltage drop reference product packaged in a miniature 3-pin SOT-23 package. With static current of 42 μA, the REF3025AIDBZR provides an excellent temperature drift and initial accuracy without the need for load capacitance to maintain stability. The energy storage circuit comprises a Schottky diode (e.g., a CRS08(TE85L, Q, M) Schottky diode) and 4 parallel capacitors as backup circuits with an output voltage of no less than nVCC. The CRS08 Schottky diode can reverse the current compared to other diodes. Due to the small surface mount package, it is suitable for compact assembly.

Figure 11:
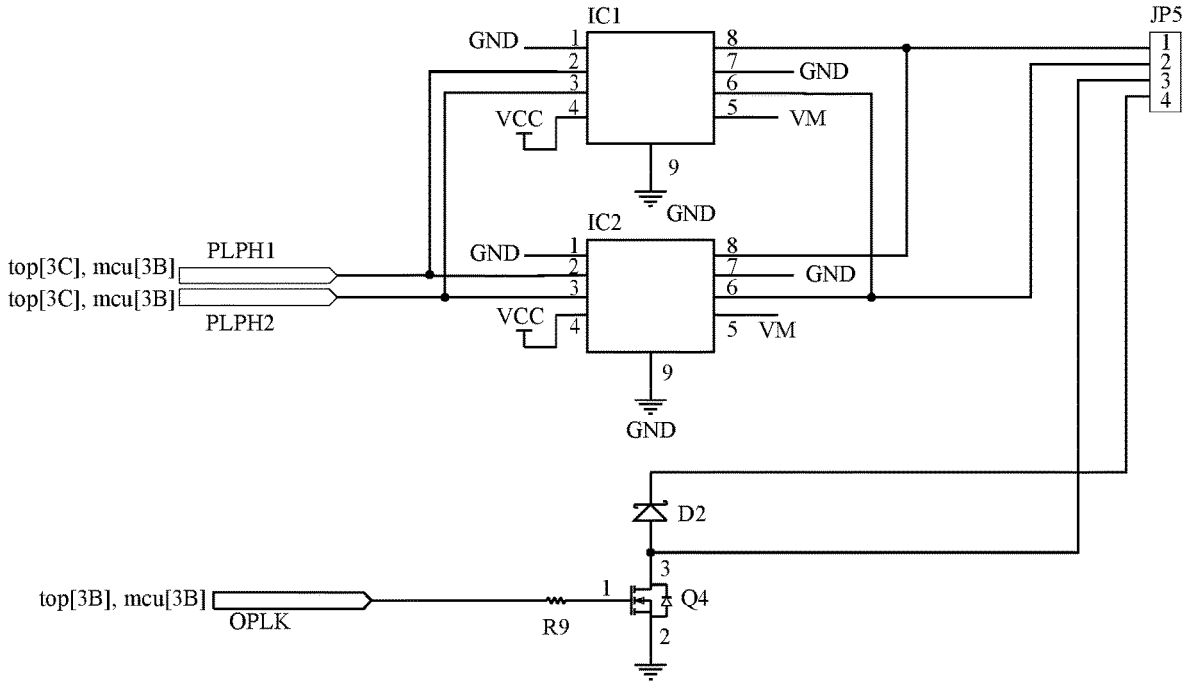
FIG. 11 is the circuit diagram of the sensor module.

Referring to FIG. 11, the drive module comprises a coil action circuit and an electrical latch activation circuit. The coil action circuit comprises two brush-type DC motor drivers (e.g., DRV8870DDAR motor drivers). The DRV8870DDAR motor driver controls a H-bridge driver circuit with two logical inputs, capable of bidirectional motor control with peak current up to 3.6 A. The magnetic field in different directions is formed by the positive and negative flow of the current, so as to exert thrust or tension on the sliding clamp. The electric latch activation circuit comprises a Schottky diode and an N-channel MOS diode. When the electric latch is activated, the slip ring can slide smoothly. As described previously, DMG3404L-7 diodes have a low on-resistance, a low input capacitance and a fast switching speed, which can minimize the on-resistance while maintaining excellent switching performance. CRS08 Schottky diodes can reverse the current compared to other diodes, also as described previously. Due to its small surface mount package, it is suitable for compact assembly.

The above specific embodiments, the purpose of the invention, technical scheme and beneficial effect are further detailed, it should be understood that the above is only the specific implementation of the invention, and is not used to limit the scope of protection of the patent of the invention, where within the spirit and principles of the invention, any modification, equivalent replacement, improvement, etc. shall be included in the protection scope of the invention.

What is claimed is:

1. A fracking tool with an electromagnetic intelligent control sliding sleeve, the fracking tool comprising an outer sleeve section, a dart body section, and a control section, wherein:

the outer sleeve section comprises a front casing pipe, a nozzle plug, a piston barrel and a back casing pipe;

the dart body section comprises a plugging ball, snap claws, snap screws, a ball seat snap ring, a magnet cover and a magnet, an upper latch, a rear inner tube, a rubber sleeve, a snap locking cylinder, a lower latch, a strain sensor cover and a strain sensor, a conduit, a magnetic sensor cover and a magnetic sensor, a sliding snap ring, a front inner tube, a magnetic induction coil, an electric latch and a snap ring screw; and the control section comprises a main control module, a drive module, a power supply module and a sensor module, integrated on a printed circuit board (PCB).

2. The fracking tool according to claim 1, wherein the front casing pipe and the back casing pipe are connected by a threaded fitting, the piston barrel and the front casing pipe are fixed by pins, the front casing pipe is configured with multiple oil drain ports along a circumference thereof, and each oil drain port is configured with a nozzle plug.

3. The fracking tool according to claim 1, wherein the snap claws and the ball seat snap ring are fixed by the snap screws, the front inner tube and the ball seat snap ring are axially fixed by the snap ring screw, the rear inner tube is configured with three rectangular cavities and forms a sealed cavity with the lower latch, and the rear inner tube has a top configured with a groove to cooperate with the rubber sleeve.

4. The fracking tool according to claim 3, wherein a control system is in the sealed cavity, and the strain sensor is in a groove in a middle section of the upper latch and transmits a collected signal to the PCB through a channel inside the upper latch.

5. The fracking tool according to claim 1, wherein the dart body section has an active state and an inactive state.

6. The fracking tool according to claim 5, wherein the fracking tool further comprises a dart body and a plurality of outer sleeves, and when the dart body section is in the inactive state, the dart body can pass through any of the plurality of outer sleeves without being blocked, and when the dart body section is in the active state, the dart body is blocked and detained.

7. The fracking tool according to claim 6, wherein the dart body section is not in the active state at an initial stage of operation, and the dart body is not blocked at any position.

8. The fracking tool according to claim 6, wherein when the dart body passes a previous one of the plurality of outer sleeves at a target position, the dart body switches to the active state and is intercepted by a designated one of the plurality of outer sleeves.

9. The fracking tool according to claim 6, wherein when a pressure reaches a certain value, one of the nozzle plugs opens.

10. The fracking tool according to claim 6, wherein the dart body passes through the piston barrel to lock the upper latch.

11. The fracking tool according to claim 10, wherein when the dart body passes through the piston barrel, a deformation occurs, a control system collects and counts a deformation signal, and when a deformation signal count reaches a set value, the control system controls the magnetic induction coil to activate the dart body section.

12. The fracking tool according to claim 1, wherein the upper latch has one end comprising a claw-like structure with a cylindrical hole therein configured to receive or enable installation of the magnetic sensor, and another end is connected with the lower latch through threaded fittings.

13. The fracking tool according to claim 1, wherein the magnetic sensor collects a deformation signal from a locking buckle tip.

* * * * *